United States Patent [19]

Gassner et al.

[11] Patent Number: 4,809,898

[45] Date of Patent: Mar. 7, 1989

[54] EXPLOSIVE CHARGE OPERATED TOOL FOR FASTENING ELEMENTS

[75] Inventors: Theo Gassner, Triesenberg, Liechtenstein; Peter Von Flue, Degersheim, Switzerland

[73] Assignee: Hilti Aktiengesellschaft, Fürstentum, Liechtenstein

[21] Appl. No.: 25,161

[22] Filed: Mar. 12, 1987

[30] Foreign Application Priority Data

Mar. 12, 1986 [DE] Fed. Rep. of Germany ..... 3608146

[51] Int. Cl.[4] ..... B25C 1/04

[52] U.S. Cl. ..... 227/8; 227/125

[58] Field of Search ..... 227/8–10,125; 173/13, 15

[56] References Cited

U.S. PATENT DOCUMENTS

| | | | |
|---|---|---|---|
| 3,615,049 | 10/1971 | Obergfell et al. | 227/10 |
| 3,991,925 | 11/1976 | Buchel | 227/10 |
| 4,197,974 | 4/1980 | Morton et al. | 227/8 |
| 4,597,517 | 7/1986 | Wagdy | 227/8 |

*Primary Examiner*—Frank T. Yost
*Assistant Examiner*—James L. Wolfe
*Attorney, Agent, or Firm*—Toren, McGeady & Associates

[57] ABSTRACT

An explosive powder charge operated tool for driving nails includes a housing with a muzzle part mounted in and projecting axially outwardly from the housing. By moving the muzzle part rearwardly into the housing, the tool is in the ready-to-fire condition. A magazine is supported at one end within the muzzle part and extends generally radially outwardly from it. A slide in the magazine feeds individual nails in a nail strip into the bore in muzzle part into position to be driven by a piston located within the housing. When all of the nails in the strip have been driven from the tool, one end of the strip projects into the muzzle bore. A stop shoulder on the one end of the strip faces toward an end face on the housing and contacts the end face when the muzzle part is pressed into the housing, preventing the placement of the tool in the ready-to-fire condition.

4 Claims, 1 Drawing Sheet

EXPLOSIVE CHARGE OPERATED TOOL FOR FASTENING ELEMENTS

BACKGROUND OF THE INVENTION

The present invention is directed to an explosive powder charge operated tool for driving fastening elements, such as nails, into a receiving material. The tool includes a housing with a muzzle part displaceable from a first position rearwardly into the housing into a ready-to-fire condition. A magazine supported at one end in the muzzle part extends outwardly and contains a slide for feeding the fastening elements out of the magazine into the bore of the muzzle part. The slide is displaceable through the magazine into an end position when all of the fastening elements have been fed into the muzzle bore and driven out of the tool.

Known explosive powder charge operated tools, as a rule, include a contact pressure safety assuring that the firing of an explosive powder charge is possible only when the muzzle part is pressed against the receiving material so that it moves into the housing. Accordingly, the muzzle part is moved rearwardly into the ready-to-fire condition and, in most cases, compresses a spring in a known firing mechanism.

SUMMARY OF THE INVENTION

To provide a simple arrangement for carrying out this safety feature in tools having a magazine projecting laterally outwardly from the muzzle part, where a slide for feeding the fastening elements is supported within the magazine as disclosed in DE-OS No. 24 33 642, it is the primary object of the present invention to provide a contact safety for preventing the initiation of the firing of the tool when there is no fastening element in the muzzle bore.

In accordance with the present invention, the slide in the magazine includes a stop shoulder located in the end position when all of the fastening elements have been fed out of the magazine and driven from the tool, with the stop shoulder aligned with a front end face of the housing so that the rearward movement of the muzzle part causes the stop shoulder to contact the front end face on the housing and prevent further movement of the muzzle part into the housing so that the ready-to-fire condition cannot be established.

In the end position when all of the fastening elements have been displaced out of the magazine and driven out of the tool, the stop shoulder on the slide is located in the path of the front end face of the housing, that is in the path of movement of the housing relative to the muzzle part. With the tool in this condition, when the muzzle part is pressed against the receiving material, the housing moves relative to the muzzle part only until its front end face abuts against the stop shoulder. This relatively slight displacement movement is not sufficient to place the tool in the ready-to-fire condition. The ready-to-fire condition can be reached only when a pin-shaped member abuts against a stop located outside the magazine.

The magazine can be constructed to be opened and it can have a U-shaped cross-section or it can be provided with a closed box configuration. The slide which feeds the nails or fastening elements out of the magazine into the muzzle bore is preferably supported in the magazine as it moves in the feed direction.

Advantageously, the stop shoulder is formed by the end face of the slide leading in the feed direction. The use of the end face as a stop shoulder makes separate measures superfluous, so that the invention involves the shape of the slide having a particularly simple arrangement.

In a preferred embodiment, the stop shoulder is formed by the end of the slide facing toward a front end face of the housing as it moves into the box-shaped magazine. The box-shaped magazine is provided with an aperture so that the housing can move relative to the magazine into contact with the shoulder.

The box-shaped configuration of the magazine provides a secure and protected guidance of the fastening elements. To insert fastening elements into the magazine, it can be opened by removing one side or by pivotally opening a side wall. In the open condition, the slide can be returned back to its starting position. The stop shoulder on the slide is protected by the configuration of the box-shaped magazine so that effective operation is assured.

Another important feature of the invention is the provision of a feed nose on the end of the slide projecting forwardly from the stop shoulder for pressing the nail strip toward the muzzle bore so that individual fastening elements or nails can be inserted into the bore. The feed nose leads the stop shoulder in the feed direction of the nails into the . tool. The arrangement of the feed nose does not interfere with the movement of the muzzle part so that the ready-to-fire condition of the tool is achieved. When the last nail is being fed from the magazine into the muzzle bore the feed nose is aligned with the front end face of the housing but does not interfere with the establishment of the ready-to-fire condition.

To assure that the feed of the fastening elements or nails and the attainment of the end position of the slide does not require manual operation, a spring element is located within the magazine and biases the slide from the starting position into the end position. The spring element can be in the form of a tension or compression spring.

The various features of novelty which characterize the invention are pointed out with particularity in the claims annexed to and forming a part of this disclosure. For a better understanding of the invention, its operating advantages and specific objects attained by ts use, reference should be had to the accompanying drawings and descriptive matter in which there are illustrated and described preferred embodiments of the invention.

DETAILED DESCRIPTION OF THE INVENTION

Figures 1, 2, 3, 4:
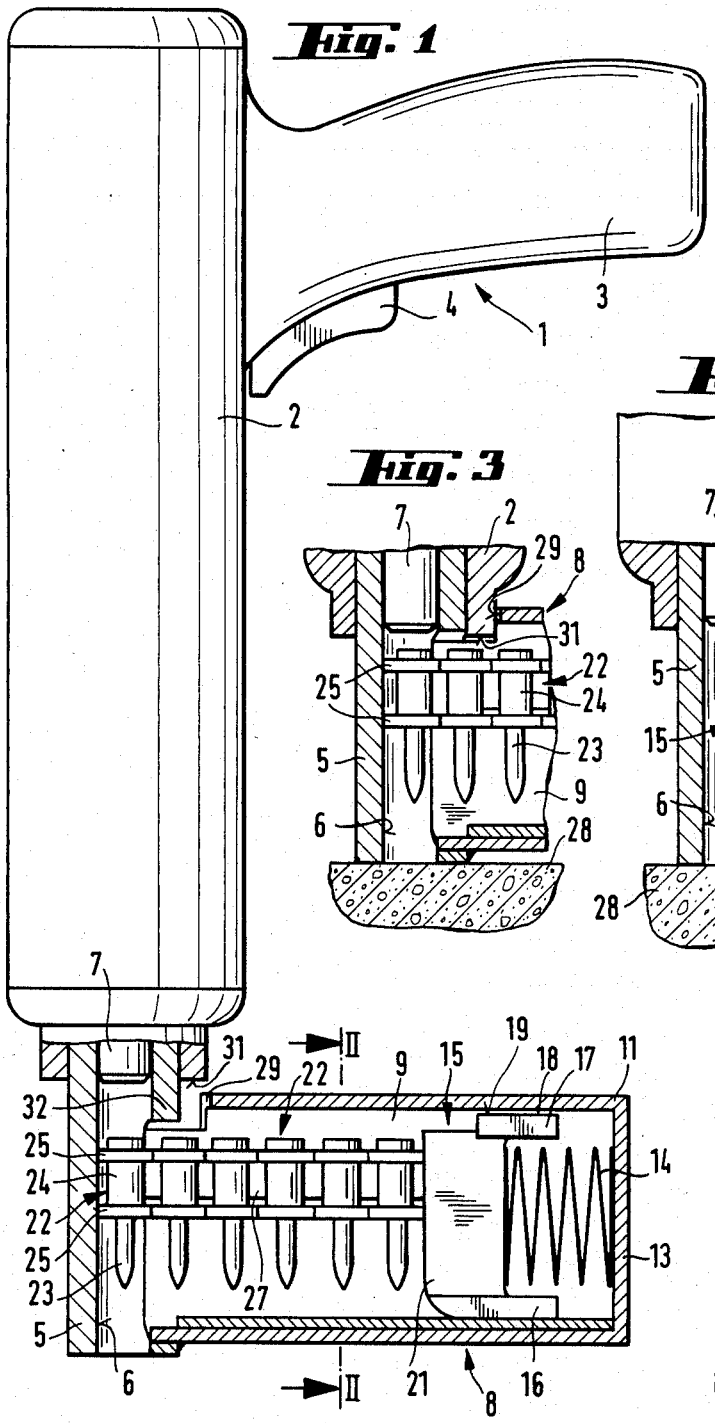
FIG. 1 is a side elevational view of a tool for driving fastening elements, with the tool facing downwardly, and with the forward end of the tool, containing the fastening elements, shown in section.
FIG. 2 is a cross-sectional view taken along the line II—II in FIG. 1.
FIG. 3 is a partial showing of the tool in FIG. 1 with the front end of the tool, shown in section, bearing against a receiving material with the tool in the ready-to-fire condition.
FIG. 4 is a view similar to FIG. 3, shown partly in section with the tool pressed against the receiving material after all of the fastening elements have been driven.

In FIG. 1, the tool 1 for driving fastening elements, such as nails, into a receiving material is shown with the tool including a housing 2 having a downwardly directed front end and with a handle 3 projecting laterally outwardly from the rear end of the housing. A trigger 4 is located in the handle for actuating or firing an explosive powder charge. Since explosive powder charges inserted into a firing chamber at the end of a barrel within the housing are well known, the charge and the firing chamber have not been illustrated. When the tool 1 is in the ready-to-fire condition, the explosive powder charge is in the effective range of a firing pin actuated by the trigger 4. As viewed in FIG. 1, the driving direction is the downward direction out of the front end of the housing. A muzzle part 5 is supported in and projects axially out of the housing in the driving direction. Muzzle part 5 is movably displaceable, from the rest or non-firing condition of the tool shown in FIG. 1, opposite to the firing direction rearwardly into the housing so that the tool is in the ready-to-fire condition shown in FIG. 3. Muzzle part 5 has an axially extending muzzle bore 6 which receives a piston 7, shown only in part, which is driven forwardly through the housing into the muzzle bore 6 by the explosive gases generated by the explosive powder charge. As the piston is propelled forwardly into the muzzle bore it contacts the rear end of a fastening element and, drives- it forwardly out of the bore into a receiving material 28. At the muzzle part 5, a box-shaped magazine 8 is secured at one end at an opening into the muzzle part. The interior of the magazine 8 forms a guide channel or passageway 9 opening into the muzzle bore 6. As can be seen in FIG. 2, the magazine 8 is constructed of a U-shaped main part 11 and a removable L-shaped side wall 12 which closes the open side of the main member 11. Side wall 12 can be fastened to the main member 11 by a snap-in connection in a known manner. A compression spring 14, formed of strip material, abuts a rear wall 13 of the main member 11 and the spring contacts a slide 15 and biases the slide in the leftward direction as viewed in FIG. 1, toward the muzzle bore 6 of the tool 1. Slide 15 is guided within the passageway 9 in the magazine 8 by guide strips 16 and 17 on the lower and upper sides of the strip in sliding contact with the inside surfaces of the lower and upper walls of the passageway 9.

Guide strip 17 has a surface 18 facing in the direction toward the housing and forming a stop shoulder 19 moving with the slide 15 in the direction feeding fastening elements into the muzzle bore 6. A feed nose 21 projects in the feed direction of the slide 15 toward the muzzle bore 6 ahead of the stop shoulder 19. The feed nose 21 bears against a strip or belt of nails or fastening elements 22 interconnected with one another in a row-like arrangement.

The fastening elements 22 in the strip include a plurality of nails 23 arranged in parallel relation and a guide bushing 24 on each nail formed of a plastics material, note FIG. 2. The opposite axially-spaced ends of the guide bushings 24 have circular guide rings 25 projecting laterally outwardly from an axially extending section 26 extending between the guide rings 25. The section 26 is recessed inwardly from the circumferential surfaces of the guide rings 25, forming an annular recess around the guide bushing. A support strip 27 is located on the main member 11 extending in the feed direction within the magazine 8, and the strip projects into the annular recess formed in the guide bushing and retains the individual nails parallel to the axial direction of the muzzle bore 6.

By pressing the tool 1 against the receiving material 28, as shown in FIG. 3, the muzzle part 5 moves relative to the housing 2 so that the front end of the housing 2 is located closer to the surface of the receiving material and the muzzle part 5 moves into the housing. During such relative movement, compare FIG. 1 and FIG. 3, the front end of the housing extends through a recess 29 formed in the magazine 8, and enters into the passageway 9 within the magazine. The feed of the individual nails 23 into the muzzle bore 6 is not obstructed by the relative movement of the muzzle part and the housing. When the muzzle part 5 is displaced rearwardly into the housing, the tool is in the ready-to-fire condition and can be fired by actuating the trigger 4. When the explosive powder charge is ignited, the gases generated propel the piston 7 forwardly through the housing against the nail 23 and bushing 24 located within the muzzle bore 6 and drive the nail into the receiving material 28 and at the same time destroy the guide bushing 24. After the piston 7 is returned into the ready-to-fire position, the next fastening element formed by the nail 23 and the bushing 24 enters into the muzzle bore 6. When the last one of the fastening elements 22 in the strip within the magazine 8 is driven out of the muzzle bore, and the piston 7 is returned into the ready-to-fire position, the slide 15 moves into the muzzle bore 6, that is, the feed nose 21 enters into the muzzle bore in the path of the piston 7. In this end position, stop shoulder 19 is located aligned with the front end face 31 of the housing 2 and the guide strip 17 abuts against a wall portion of the muzzle part 5. If the front end of the tool, that is the front end of the muzzle part 5, is pressed against the surface of the receiving material 28, the front end face 31 on the housing contacts the stop shoulder 19 after a portion of the movement of the muzzle part 5 relative to the housing 2 into the ready-to-fire condition so that such condition cannot be attained, note FIG. 4. Only after the magazine 8 is filled with a new supply of fastening elements 22, with the slide returned to its starting position, note FIG. 1, the tool is again ready to commence the driving of the fastening elements into the receiving material.

While specific embodiments of the invention have been shown and described in detail to illustrate the application of the inventive principles, it will be understood that the invention may be embodied otherwise without departing from such principles.

We claim:

1. Explosive powder charge operated tool for driving fastening elements such as nails, into a receiving material, comprising a housing having a front end and a rear end and an axial direction extending in the front-end rear-end direction, a muzzle part extending in the axial direction and mounted in and extending out of the front end of said housing, said muzzle part having an axially extending bore therein and being displaceable between a first position into a ready-to-fire position displaced axially inwardly into said housing from the first position, a magazine having an end mounted in an opening in said muzzle part and extending transversely of the axial direction outwardly from said muzzle part, a slide located in said magazine and arranged to feed a strip of fastening elements one at a time through the end of said magazine into said muzzle part bore, means for displacing said slide through the magazine toward said bore into an end position when all of the fastening elements in the strip have been driven from the muzzle part bore, wherein the improvement comprises that said slide has a first end leading toward said muzzle part as said strip of fastening elements is displaced toward said muzzle part with the first end contacting the strip of fastening elements, said housing having an end face at the front end thereof extending transversely of the axial direction and in alignment with the end of said magazine at the muzzle part, a stop shoulder on said slide facing toward and being aligned with said end face of said housing in the end position of said slide and said stop shoulder moving into contact with said end face of said housing in the end position of said slide for preventing movement of said muzzle part relative to said housing whereby said muzzle part cannot be displaced sufficiently into said housing into the ready-to-fire position, said stop shoulder is formed by a surface extending transversely of the axial direction and located on a guide strip on said slide and facing toward and aligned with said housing only when said slide enters the end position when all of the fastening elements have been driven from the strip, said magazine has an opening therein adjacent to said muzzle part so that said end face at the front end of said housing can move inwardly through said opening into said magazine into contact with said surface on said stop shoulder in the end position, said slide has a feed nose at the first end thereof arranged to bear against the strip of fastening elements with said feed nose projecting outwardly from said stop shoulder in the direction of movement of the slide toward said muzzle part and said feed nose located within said muzzle part in said end position.

2. Explosive powder charge operated tool, as set forth in claim I, wherein said means for displacing said slide comprises spring means within said magazine biasing said slide in the direction toward said muzzle part and finally into the end position thereof.

3. Explosive powder charge operated tool, as set forth in claim 1, wherein means located within said magazine for guiding said strip of fastening elements toward said muzzle part for maintaining said fastening elements in parallel relation with the axis of said muzzle part bore.

4. Explosive powder charge operated tool, as set forth in claim 1, wherein a piston is located within said housing for driving the fastening elements, and in the end position the first end of said slide enters into the path of said piston within said muzzle bore.

* * * * *